United States Patent [19]

Ericson

[11] Patent Number: 4,974,632

[45] Date of Patent: Dec. 4, 1990

[54] AUTOMATIC AIR VALVES FOR DUCTS

[76] Inventor: Kurt S. B. Ericson, Prins Boudewijnlaan 48, Schilde, Belgium

[21] Appl. No.: 441,258

[22] Filed: Nov. 27, 1989

Related U.S. Application Data

[63] Continuation-in-part of Ser. No. 301,547, Jan. 26, 1989, abandoned.

[51] Int. Cl.[5] ..... E03C 1/12

[52] U.S. Cl. ..... 137/526; 4/209 FF; 4/211; 4/218; 137/544; 137/545; 137/550

[58] Field of Search ..... 55/478, 480, 497, 525; 4/209 FF, 211, 218; 137/217, 526, 544, 545, 550; 210/497.3

[56] References Cited

U.S. PATENT DOCUMENTS

| | | | |
|---|---|---|---|
| 1,111,633 | 9/1914 | Young | 55/478 |
| 1,303,529 | 5/1919 | York | 137/545 X |
| 1,627,840 | 5/1927 | Donnelly | 137/526 |
| 1,681,697 | 8/1928 | Brooks | 137/550 X |
| 2,346,022 | 4/1944 | Gonia | 55/497 X |
| 2,405,241 | 8/1946 | Smith | 137/526 |
| 3,923,081 | 12/1975 | Persson | 137/217 |
| 4,198,726 | 4/1980 | Powell | 55/525 X |
| 4,232,706 | 11/1980 | Ericson | 137/526 X |
| 4,535,807 | 8/1985 | Ericson | 137/526 X |
| 4,712,574 | 12/1987 | Perrott | 137/217 |

FOREIGN PATENT DOCUMENTS

| | | | |
|---|---|---|---|
| 2112906 | 7/1983 | United Kingdom | 137/526 |

*Primary Examiner*—Gerald A. Michalsky
*Attorney, Agent, or Firm*—Leonard Bloom

[57] ABSTRACT

An automatic air valve for a conduit, through which passes fluids and/or solids, which valve utilizes a freely-movable valve member to prevent the discharge of contaminated air therefrom into the environment and to permit the introduction of fresh air from the environment into the conduit when a negative pressure develops therein. The air valves may be disposed at either the terminus of or interposed within the conduit flow line of a duct system. The air valves include an interior filter that restrains foreign objects, such as insects and snakes, in the duct system from operatively interfering with the freely-movable valve member. Means is also included for preventing the interior filter to move or to be moved into a position wherein the interior filter may operatively interfere with the freely-movable valve member. The interior filters are nonplanar in shape, so as to provide a total air passage area that is substantially the same as the air passage area that is present without the interior filter.

3 Claims, 8 Drawing Sheets

AUTOMATIC AIR VALVES FOR DUCTS

CROSS-REFERENCE TO RELATED APPLICATION

The instant application is a continuation-in-part of U.S. patent application Ser. No. 301,547 filed Jan. 26, 1989, now abandoned, the contents of which are incorporated herein in their entirety.

FIELD OF THE INVENTION

The present invention relates to automatic air valves for ducts through which passes fluids and/or solids and, in particular, to automatic air valves for sanitation waste pipes which valve employ freely-movable valve members to prevent the discharge of contaminated air therefrom and to permit the introduction of fresh air into the ducts when a negative pressure develops therein.

BACKGROUND OF THE INVENTION

Automatic air valves for duct systems, which both prevent the discharge of contaminated air therefrom and allow ambient air to enter the ducts when a negative pressure occurs therein (for example, upon the flushing of a water cabinet of a sanitation system), are well-known. Such air valves employ valve members which may be either "freely-movable" or "nonfreely-movable". The term "freely-movable" refers to those valve members which are intended to slide (in guides or otherwise) only in response to pressure and air flow. The term "nonfreely-movable" refers to those valves valve members which are constantly biased into, or are otherwise restrained in, a particular (normally closed) position.

Traditionally, such air valves employ nonfreely-movable valve members, such as the spring-loaded valve member disclosed in U.S. Pat. No. 2,405,241 issued to Smith. While valves employing such nonfreely-movable valve members operate effectively, they are not always as sensitive to changes in pressure as is desired or needed.

To increase the sensitivity of such automatic valves, it has been proposed to equip such automatic air valves with freely-movable valve members. Such automatic air valves that include freely-movable valve members are disclosed in U.S. Pat. Nos. 3,923,081 issued to Persson and 4,232,706 issued to Ericson.

In the variety of automatic valves that utilize freely-movable valve members to control the flow of air in and out of the duct, in order to attain the desired increase in sensitivity, the valve member must be capable of freely moving in response to even certain slight pressure and air movements. Accordingly, these freely-movable valve members are much more readily subject to being blocked, knocked out of alignment, or otherwise operatively interferred with. This can result in, for example, preventing the freely-movable valve member from being fully opened (unseated) or closed (seated). A major source of such blockage and interference are insects, small animals and other foreing objects, such as debris, which may enter the valve from the ambient enviroment and come into contact with the freely-movable valve member therein.

To solve the problem of blockage or interference resulting from such foreing object from the ambient enviroment, an automatic air valve was disclosed in U.S. Pat. No. 4,535,807 issued to Erisson. In this valve, a grill is disposed over the exterior end of the passageway through which the air passes into the conduit. This grill acts as a filter for preventing and protecting against the entry into the passageway of those foreign objects, thereby preventing them from coming into contact with, or otherwise interfering with, the proper operation of the freely-movable valve member.

While such an arrangement is extremely useful for preventing the entry of foreign objects from the ambient environment, it offers no protection whatsoever from foreign objects, such as insects, reptiles, small animals or other matter which originate from within the duct system itself. In warmer climates, such as in certain southern portions of the United States, it is common for insects and reptiles (such as snakes) to inhabit such duct systems, especially when the ducts are part of a sanitation system. These foreign objects that originate in the duct system can, despite the presence of the grills disclosed in Ericson '807, still comes in contact with, and/or otherwise interfere with, the proper operation of the freely-movable valve member (for example, by preventing the freely-movable valve member from being fully opened and/or closed), and of the automatic air valve.

Complicating this problem is the fact that sometimes these valves must be interposed directly in the conduit flow line of the duct system. In such cases, the valve must be equipped so that the flow of fluids and/or solids through the conduits of the duct system is not obstructed.

The use of interior filters in automatic air valves that employ nonfreely-movable valve members has also been disclosed. In Smith '241 an interior filter is utilized in a valve that employs as spring-loaded valve member. However, use of such a filter, as taught therein, is only for the purpose of preventing foreign objects in the ambient environment from entering the drain pipe via the valve and valve member. In this respect, foreign objects would come into contact with (and operatively interfere with) the valve member before they would be restrained by the filter.

Also, the filter disclosed by Smith '241 may be moved upwardly towards the valve member by, for example, a snake in the drain pipe, until the filter actually contacts the valve member. Such contact would operatively interfere with a freely-movable valve member. There is no means whatsoever suggested by Smith '241 to prevent such movement of the interior filter, so that it does not contact or otherwise operatively interefere with the valve member. There is no suggestion whatsoever to permit the use of interior filter described in Smith '241 to restrain foreign objects originating in the drain pipe from entering the valve and operatively interfering with the valve member. While such a feature may not be important in a valve employing a nonfreely-movable valve member, it is essential where use of a freely-movable is employed.

Finally, it is noted that the interior filters disclosed of which I am aware are planar plates that have a plurality of apertures or air passages formed therein. Unfortunately, such a shape effectively reduces the total air passage area of the valve, consequently reducing the sensitivity of the valve member. Once again, while such a feature is not essential in non-sensitive valves, such as the those that utilize nonfreely-movable valve members, it is essential for the proper operation of highly-sensitive valves that utilize freely-movable valve members.

Thus, it can be seen that there remains a need for an automatic air valve for ducts, and in particular for the ducts of a water system or a sanitation system, which employs a freely-movable valve member and which includes an interior filter by which foreign objects, such as insects, reptiles, small animals, etc., may be retained in the duct system, so that they are restrained from operatively interfering with the freely-movable valve member and, in combination therewith, a means which prevents the interior filter to move or be moved, so that the interior filter is prevented from operatively interfering with the freely-movable valve member. It can further be seen that there remains a need for such an automatic air valve, having such an interior filter which, in addition, does not restrict the flow of air therethrough.

SUMMARY OF THE INVENTION

Accordingly, it is a primary object of the present invention to provide an automatic air valve for ducts, and in particular for sanitation ducts, through which passes solids and/or fluids, which valves employs a freely-movable valve member in combination with an interior filter for retaining foreign objects, such as insects, reptiles, small animals and the like, in the duct system, so that these foreign objects are prevented from interfering with the operation of the freely-movable valve member, and a means for preventing the interior filter from operatively interfering with its freely-movable valve member.

It is another primary object of the present invention to provide such a means which also substantially does not restrict the flow of air through the valve.

It is a further object of the present invention to provide such a valve that includes an interior filter to prevent foreign objects originating in the duct system from operatively interfering with the operation of the freely-movable valve member, and which valve also permits the unobstructed passage of fluids and/or solids therethrough, thereby allowing the valve to be interposed directly within the conduit flow line of the duct system.

In accordance with the teachings of the present invention, there is disclosed an automatic air valve for a duct system having a conduit through which passes fluids and/or solids and which has a pressure therein. This valve includes a tubular member that is connected to the conduit, so that fluids and/or solids pass through the conduit. A passageway is formed in the tubular member between the conduit and the ambient environment outside the conduit, whereby gaseous communication is provided therebetween. A freely-movable valve member is disposed in communication with the passageway for automatically controlling the flow of air therethrough. The valve member is operatively freely-movable between a seated closed position and an unseated open position. In the seated closed position, flow of air through the passageway is prevented when the pressure in the conduit is equal to or exceeds the pressure of the ambient environment. In the unseated open position, the flow of air through the passageway is permitted when the pressure in the conduit is less than the pressure of the ambient environment. In this manner, atmospheric air is admitted into the conduit in response to a negative pressure in the conduit. An interior filter is disposed between the conduit and the freely-movable valve member, whereby foreign objects in the conduit are prevented from operatively interfering with the freely-movable valve member. Finally, means is provided for preventing the interior filter from operatively interfering with the freely-movable valve member.

Preferably, in combination with the above features, the interior filter is substantially nonplanar in shape, so as to provide a total air passage that substantially corresponds to the total air passage area that is present without the interior filter. In this respect, the filter substantially does not restrict the flow of air therethrough.

These and other objects of the present invention will become apparent from a reading of the following specification taken in conjuction with the enclosed drawings.

DESCRIPTION OF PREFERRED EMBODIMENTS

Figure 1:
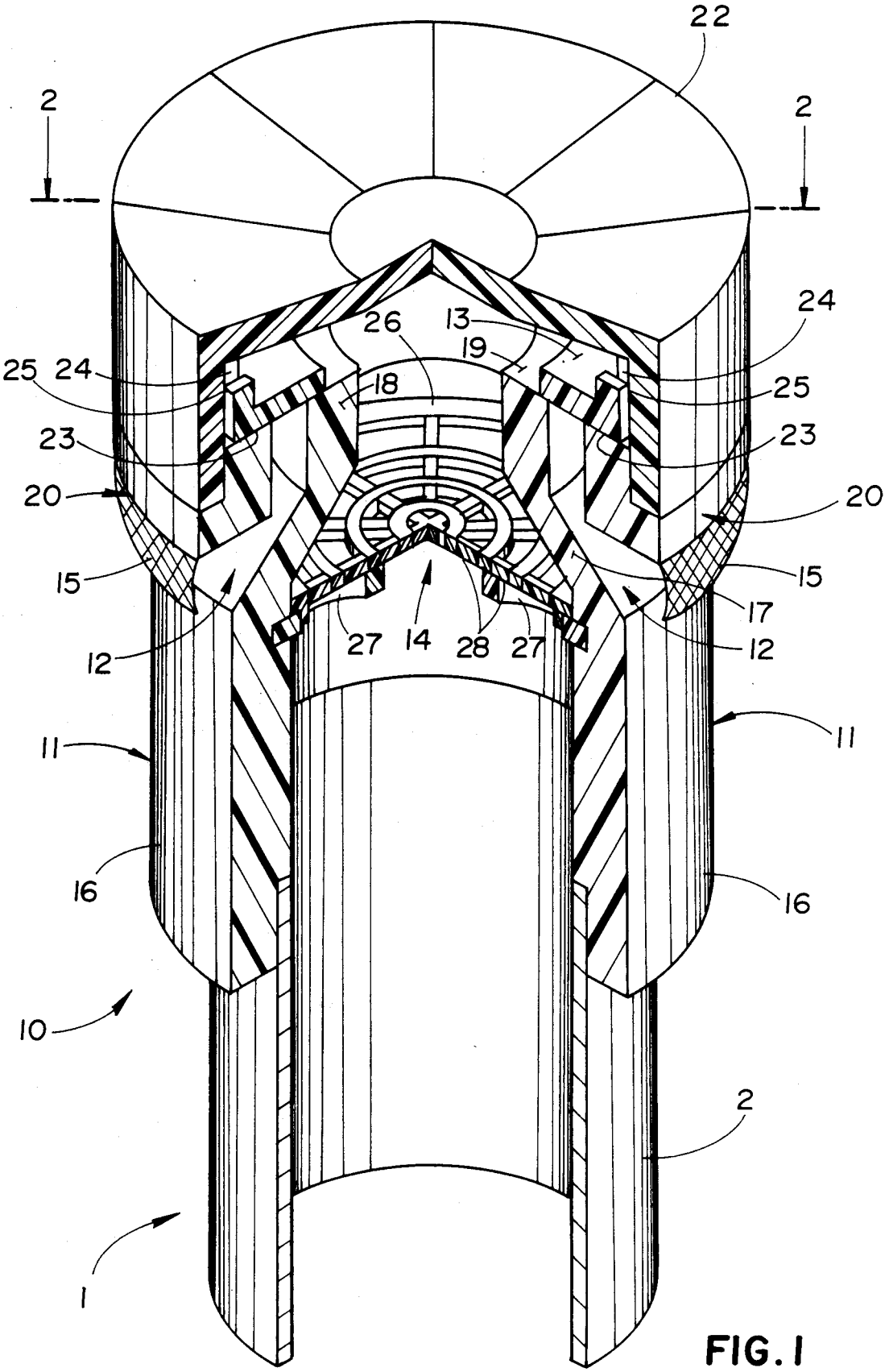
FIG. 1 is a perspective view of a first embodiment of the automatic air valve of the present invention connected to the terminus of a conduit of a duct system, with portions of the valve broken away for the sake of clarity.

The automatic air valve 10 includes a tubular member 11, a passageway 12 and a freely-movable valve member 13. Of particular interest, the valve 10 also includes an interior filter 14 having a diameter. This interior filter 14 restrains foreign objects, such as snakes and insects, from operatively interfering with the valve member 13. When used in conjunction with an exterior filter 15, this interior filter 14 insures that the freely-movable valve member 13 is not operatively interfered with by foreign objects. The movement of this interior filter 14 is itself restrained or prevented entirely, so that it cannot move, or be moved, into a position wherein it operatively interferes with the freely-movable valve member 13.

The air valve 10 may be fitted to duct system 1 having substantially vertical conduits 2 through which fluids and/or solids pass. These duct systems also have a pressure in the conduits 2 thereof. Examples of such duct systems 1 are water systems and sanitation systems. The valve 10 may be placed either at the terminus of a conduit flow line of the duct system (as at A on FIG. 7) or interposed in the conduit flow line itself (as at B on FIG. 7).

The tubular member 11 is, as shown, preferably, substantialy cylindrical, being in the form of a vertical tube. However, it is to be understood that, while illustrated as being cylindrical in form, the tubular member 11 may, alternatively, be formed having any suitable shape. This member 11 is connected to vertical conduits 2 of the duct system 1 by welding, clamping, or any other suitable means well known to those skilled in the art. Connected thusly, the interior of the tubular member 11 is in communication with the interior of the conduit 2. In this fashion, the creation of a pressure (for example, a negative pressure) in said conduit 2, consequently creates substantially the same pressure in the interior of the tubular member 11 which is in communication with the conduit 2.

Formed in the tubular member 11 is a passageway (an air inlet) 12. This passageway 12 extends between the conduit 2 and the ambient environment outside the conduit 2. In this fashion, gaseous communication is provided between the conduit 2 and the outside ambient environment for admitting air from the ambient environment into the conduit 2. Accordingly, any negative pressure occurring in the conduit 2 relative to the pressure in the ambient environment may be automatically relieved.

Disposed in communication with the passageway 12 is a freely-movable valve member 13 which rests on a seat, as shall be described at greater length below. The freely-movable valve member 13 automatically controls the flow of air (and other gases) through the passageway 12. This control is exercised by the valve member 13 being operatively freely-movable between a seated closed position and an unseated open position. When the pressure in the conduit 2 is equal to or exceeds the pressure of the ambient environment the valve member 13 is in the seated closed position, preventing the flow of air through the passageway 12. When the pressure in the conduit 2 is less than the pressure of the ambient environment the freely-movable valve member 13 is in the unseated open position, permitting the flow of air through the passageway 12. In this manner, the valve automatically admits atmospheric air into the conduit 2 in response to a negative pressure in the conduit 2. Furthermore, the valve prevents pollution of the ambient atmosphere by retaining polluted air (such as methanol and ethanol) present in the duct system (especially in the ducts of a sewage system) from escaping into the ambient environment.

If desired, an exterior filter 15 is disposed, at or over, the exterior end (the air inlet end) of the passageway 12, so as to be positioned and maintained between the ambient environment and the freely-movable valve member 13. Preferably, this exterior filter 15 is in the form of a netting or a grill which may be fabricated from any suitable material. The exterior filter 15 is disposed across the exterior end of the passageway 12. Disposed thusly, the exterior filter 15 is maintained substantially against (or secured to) the valve 10 by any suitable means, so as to prevent foreign objects, such as insects, small animals, etc., from entering the passageway 12.

Finally, an interior filter 14 is provided. This interior filter 14 is disposed between, the conduit 2 and the freely-movable valve member 13. The interior filter 14 retains foreign objects within the conduit 2. In this fashion, these foreign objects, such as insects and reptiles are restrained from operatively interfering with the freely-movable valve member 13. In this respect, the breeding areas of insects (such as mosquitos and cockroaches) that can carry contagious diseases are kept inside the duct system by the interior filter 14.

The movement of the interior filter 14 is either restrained (FIGS. 1–3) and/or the filter 14 is secured (or maintained) in place by any suitable means (FIGS. 4–6), so that the interior filter 14 can not move or be moved into a position or location wherein it can operatively interfere with the freely-movable valve member 13. If desired, to achieve this, the filter 14 may, in general, be molded from a substantially rigid material, such as plastic or metal, or it may be molded as part of the body of the valve 10. In this fashion, foreign objects, such as insects and reptiles, are prevented from moving the interior filter 14, into a location or position wherein it might operatively interfere with the freely-movable valve member 13.

Figure 2:
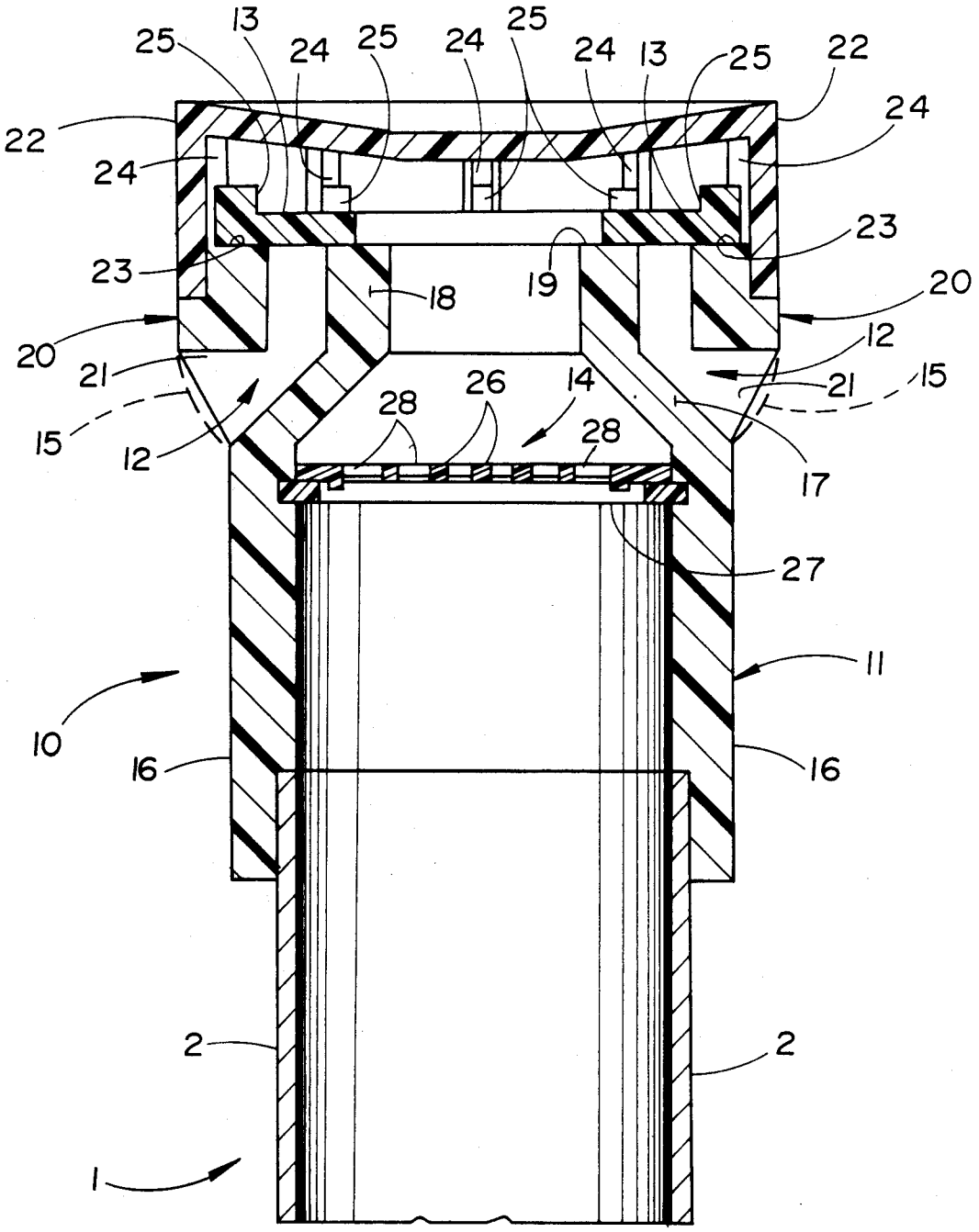
FIG. 2 is a cross-section view taken along lines 2—2 of FIG. 1.
Figure 3:
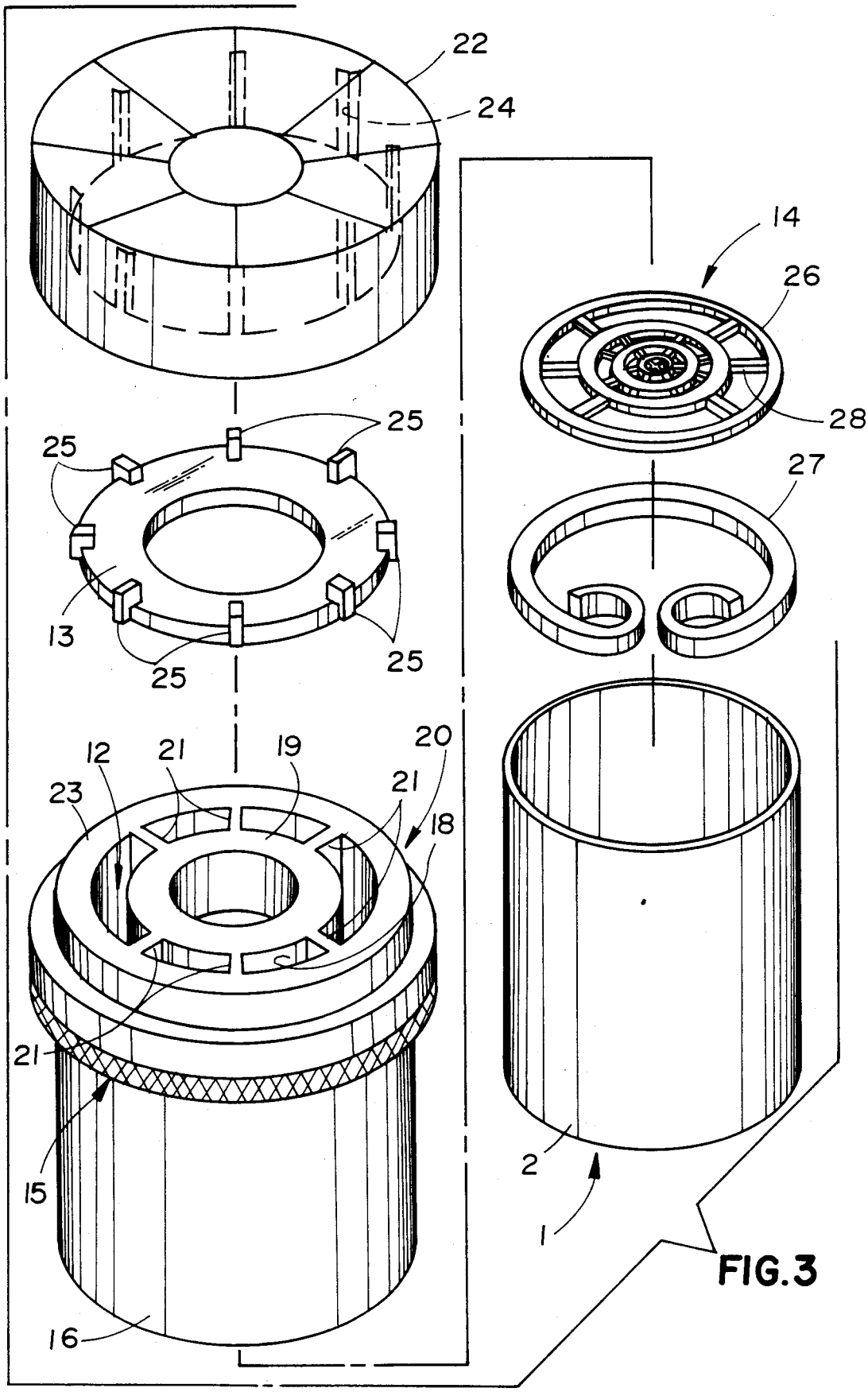
FIG. 3 is an exploded perspective view of the automatic air valve of FIG. 1.

Referring in particular now to FIGS. 1–3, the valve 10 includes the vertical tubular member 11 connected (disposed) at the terminus of one of the conduits 2 of the duct system 1.

The tubular member 11 has a lower section 16, which is connected to the conduit 2, and an upper section 17. The upper section 17 is reduced in cross-section (diameter) relative to the lower section 16. Consequently, there is also a reduction in the cross-section to a diameter of a portion of the passageway 12 located between the valve member 13 and the interior filter 14. This reduction in cross-section (upper section 17) is provided by a frustro-conical constriction in the form of a venturi having a neck 18 terminating in a first lip 19. This shape provides a venturi effect that improves the passage of air through the valve 10, thereby increasing the sensitivity thereof.

It is noted that this reduction in cross-section (upper portion 17) is to a diameter that is less than the diameter of the interior filter 14. This provides a suitable means for limiting the movement of the interior filter 14 in the direction of the valve member 13. In this fashion, the filter 14 cannot move or be moved into a position wherein the interior filter 14 may operatively interfere with the freely-movable valve member 13.

Disposed annularly about the neck 18 is an annular support ring 20. Support ring 20 is spaced from the neck 18, so that the passageway 12 (the interior end of the passageway 12) may pass therebetween. This support ring 20 is, preferably, integral with the neck 18 (and the remainder of the tubular member 11) by a plurality of crosspieces 21 which are joined to, and extend between, the exterior of the upper section 17 of the tubular member 11 and the support ring 20.

A spaced cover 22 is received on and supported by the support ring 20, so that said cover 20 overlies, and cooperates with, the upper section (the top end) 17 of the tubular member 11, so as to form in the upper section 17, the peripheral or annular passageway (flow passage) 12. This passageway 12 is in the shape of a duct having an interior end that is in communication with the interior of the conduit 2. The cover 22 may be either integral with, or separable from, the support ring 20, as desired. Alternatively, the cover 22 may be formed, so that a plurality (at least one) of passageways 12 are formed therein and not just one peripherally or annularly continuous passageway 12.

Formed on the inner periphery of the support ring 20 is a second lip 23. Lip 23 is oriented towards and cooperates with the lip 19 to form a valve seat at the exterior of the neck 18 where the interior end of the passageway 12 is located. The freely-movable valve member 13 operatively rests on this valve seat during various operations of the valve 10.

It will be seen that if a negative pressure occurs in the vertical conduit 2, for example as a result of draining, flushing, emptying or other operation, the freely-movable valve member 13 will be lifted from the valve seat formed by the lips 19 and 23 and into the unseated, open position. In this position, fresh air from the ambient environment can pass through the passageway 12 and into the conduit 2, equalizing the pressure in the conduit 2 with that of the ambient environment. Conversely, if the pressure in the vertical conduit 2 is equal to, to greater than the pressure (overpressure) in the conduit 2, the freely-movable valve member 13 will be lowered (seated) onto the valve seat formed by lips 19 and 23 and into the seated closed position. In this position, the freely-movable valve member 13 shuts off or seals the passageway 12, so that contaminated air in the conduit 2 is preventing from escaping therefrom into the ambient environment.

Because the diameter of the passageway 12 at the interior end is smaller than the diameter of the conduit 2, an increase in capacity of the valve 10 is obtained, which renders possible the use of the valve 10 in buildings having a large number of stores.

The valve 10 of the present invention may utilize whatever appropiate means desired for permitting the guiding of freely-movable valve member 13, so that it may freely-vertically, operatively move. Preferably, the means utilized includes the interior of the cover 22 having a plurality of grooves 24 formed therein. Each groove 24 cooperates with a respective rib molded on respective upwardly-extending guide lugs 25 formed on the freely-movable valve member 13. Each of the ribs of lugs 25 are received in a respective groove 24, thereby providing a guide means for guiding the freely-movable valve member 13, so that it may freely-vertically, operatively move. However, it is expressly understood that, alternatively, this means may include either inclining the inner wall of the cover 22, such as is described in U.S. Pat. No. 4,232,706, or providing the external guides disclosed in U.S. Pat. No. 4,535,807, or any other suitable means. Such means insures that the freely-movable valve member 13 does not become jammed in an oblique or horizontal position, in which the valve member 13 might stay in the open (unseated) position when the pressure has been balanced.

The interior filter 14 is disposed in the tubular member 11 between the conduit 2 and the freely-movable valve member 13. This filter 14 acts to retain foreign objects in the conduit 2, preventing said foreign objects from contacting and/or operatively interfering with the valve member 13. The movement of the interior filter 14 towards the valve member 13 is limited by the reduction in cross-section (upper portion 17) of the passageway to a diameter that is less than the diameter of the interior filter 14, as was discussed above, so that the filter 14 itself cannot operatively interfere with the freely-movable valve member 13.

The interior filter may be one of several shapes, such as planar or flat (FIGS. 1–3) or nonplanar (FIGS. 8–11).

With particular reference now to FIGS. 1–3, the interior filter 14 can be substantially planar (flat). If so, preferably this filter 14 includes a plurality of substantially concentric rings 26. Rings 26 are disposed across the inside of the upper section 17 of the tubular member 11 being supported therein by any suitable means (support members), such as circlips 27 that are received and supported in an annular groove that is formed about the interior of said member 11. These rings 26 permit gasses (such as air) to pass freely therethrough while foreign objects are retained in the conduit 2 being restrained from operatively interfering with freely-movable valve member 13. It is noted here that the support members 27 may be formed and/or positioned as desired in the interior of the member 11, so that the filter 14 may be positioned where desired below the upper portion (the reduction in cross-section) 17. Positioning of the filter 14 in relation to the upper portion 17 limits the movement of the filter 14 because, at that point of the upper portion 17, the diameter of the passageway 12 is less than the diameter of the filter 14. In this manner, the filter 14 cannot be moved, so that it operatively interferes with the freely-movable valve member 13.

At least one, and preferably a plurality, of support arms 28 are, preferably, positioned extending substantially diametrically across, the rings 26 of the filter 14 being supported on, the interior support member 27. Said support arms 28 have the concentric rings 26 disposed thereon and secured thereto. In this fashion, the concentric rings 26 are supported on the arms 28. Preferably, the arms 28 intersect one another at a common midpoint where they may be joined by welding, bolting or any other suitable means. Such joining lends the filter 14 additional structural rigidity and strength for restraing the solids in question.

Finally, the interior filter 14 is sufficiently secured in place (to either the circlips 27, the tubular member 11 and/or otherwise), so that foreign objects will not be able to dislodge or otherwise move it into a position wherein it may operatively interfere with the freely-movable valve member 13.

Referring now to FIGS. 8–11, two especially preferred embodiments of a nonplanar interior filter 14 are illustrated for use with the valve illustrated in FIGS. 1–3. Examples of such nonplanar filters range from those that are curved to those which are conical in shape. Preferably, the interior filter is frustum, including frusto-conical, shaped such as may be seen by reference to FIGS. 8–11. However, it is to be understood that any nonplanar filter may be utilized that provides a total air passage area that substantially corresponds to (approximates) the air passage area that is present without the filter 14. In this fashion, such nonplanar filters, especially those filters 14 having frustum (including frusto-conical) and conical shapes substantially do not restrict the flow of air therethrough, as much as those filters 14 that are planar. This is a very important feature in highly-sensitive valves that utilize freely-movable valve members 13, especially when taken in combination with the placement of the filter 14 below the upper portion 17, so that the filter cannot move or be moved so as to operatively interfere with the valve member 13. Indeed, the advantages and improvements in sensitivity provided by the freely-movable nature of the valve member 13 and the venturi effect provided by the upper portion 17 of reduced cross-section, might well be lost if the filter 14 too greatly restricts the air flow therethrough.

It is to be noted herein that, while preferred embodiments of the filter 14 are described above, it is to be expressly understood that, like the tubular member 11, the precise shape and structure of the interior filter 14 may be varied as desired or needed, so as to be in any suitable shape which extends across the inside of the tubular member 11. However, it is noted that, in any case, the interior filter 14 should be either sufficiently rigid, so that it cannot be deformed, for example, by foreign objects in the conduit 2, or moved, so as to operatively interfere with the freely-movable valve member 13.

Figure 4:
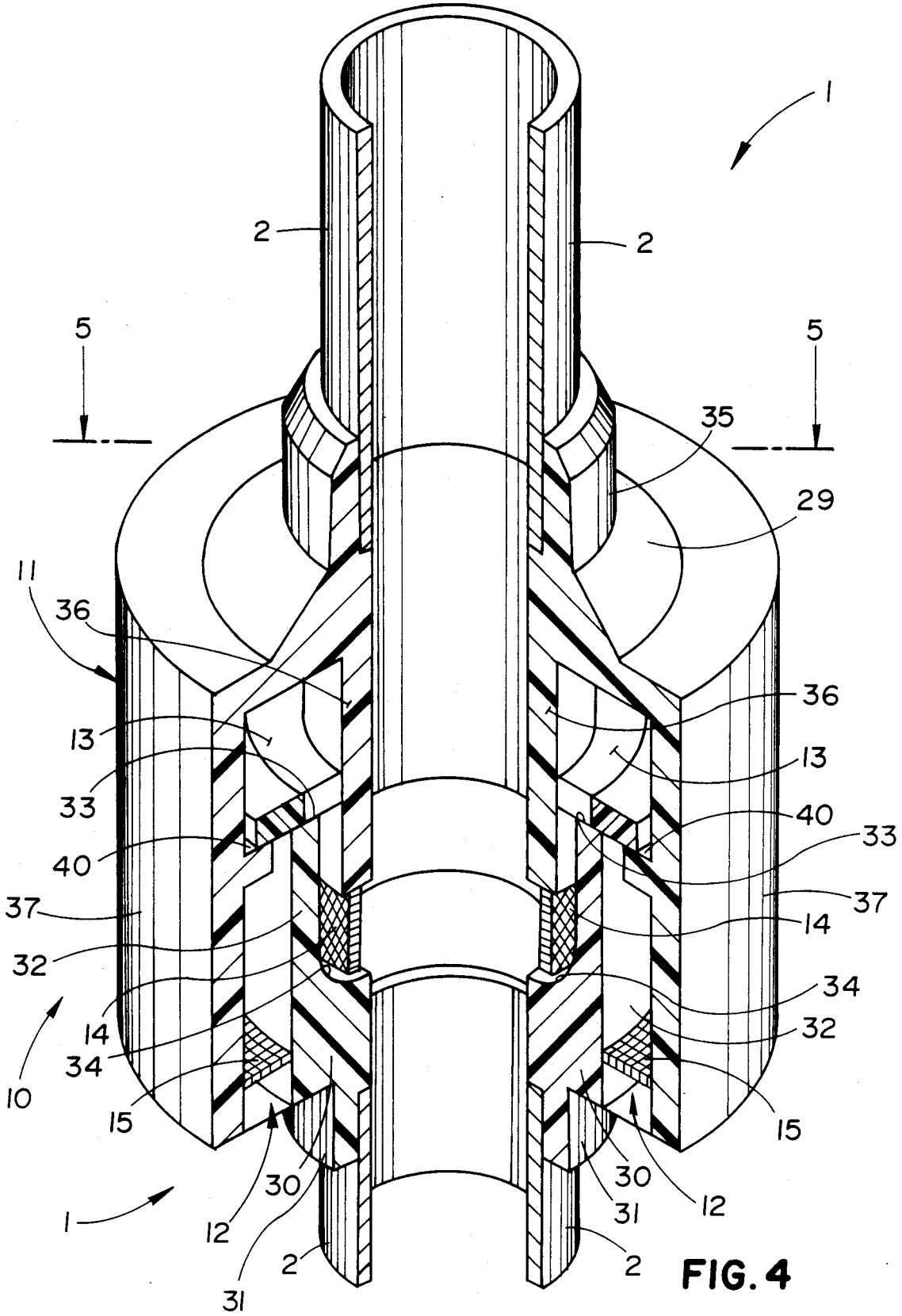
FIG. 4 is a perspective view of a second embodiment of the automatic air valve of the present invention interposed in the conduit flow line of a duct system, with portions of the valve broken away for the sake of clarity.
Figure 5:
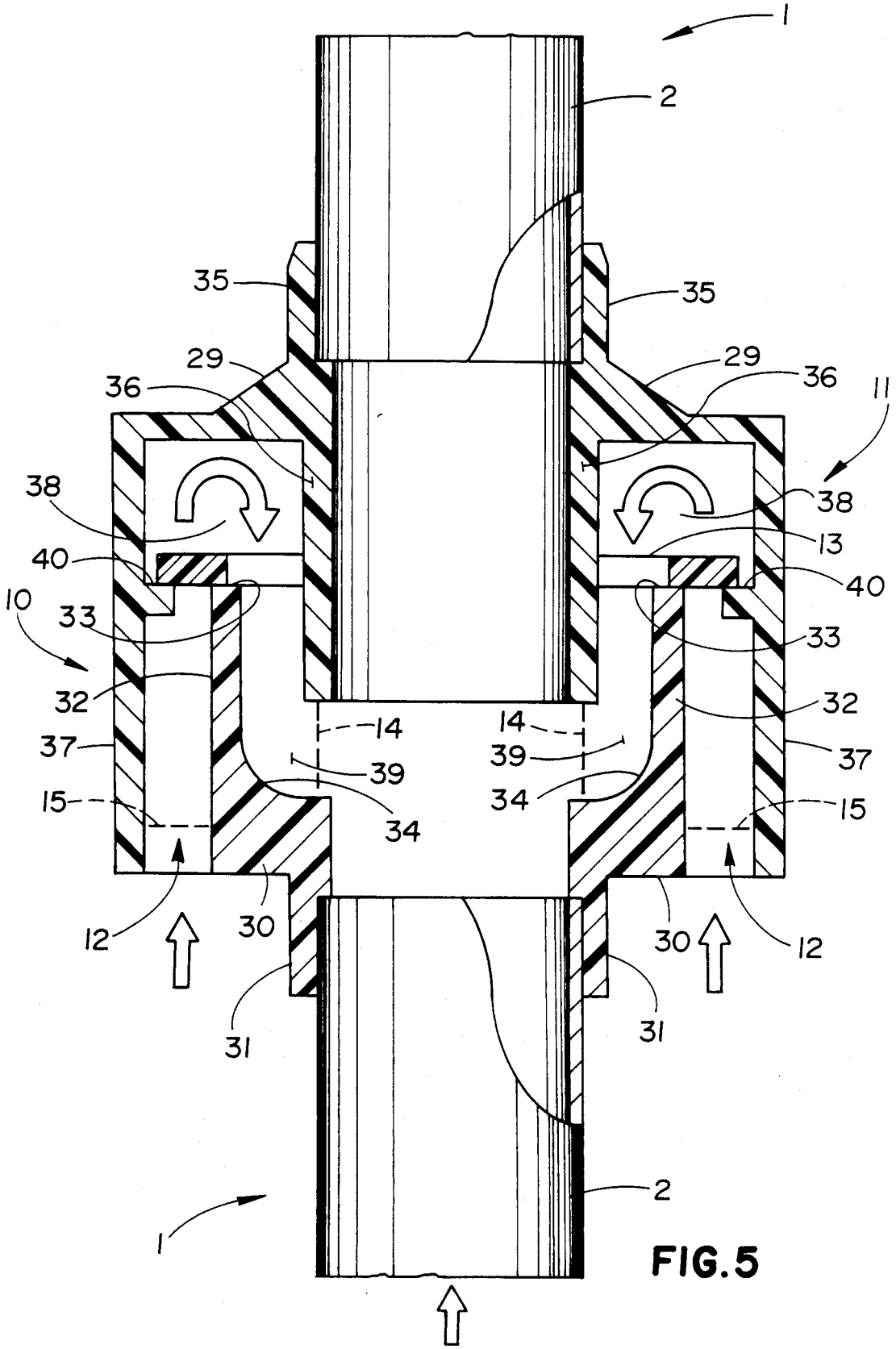
FIG. 5 is a cross-section view taken along lines 5—5 of FIG. 4.
Figure 6:
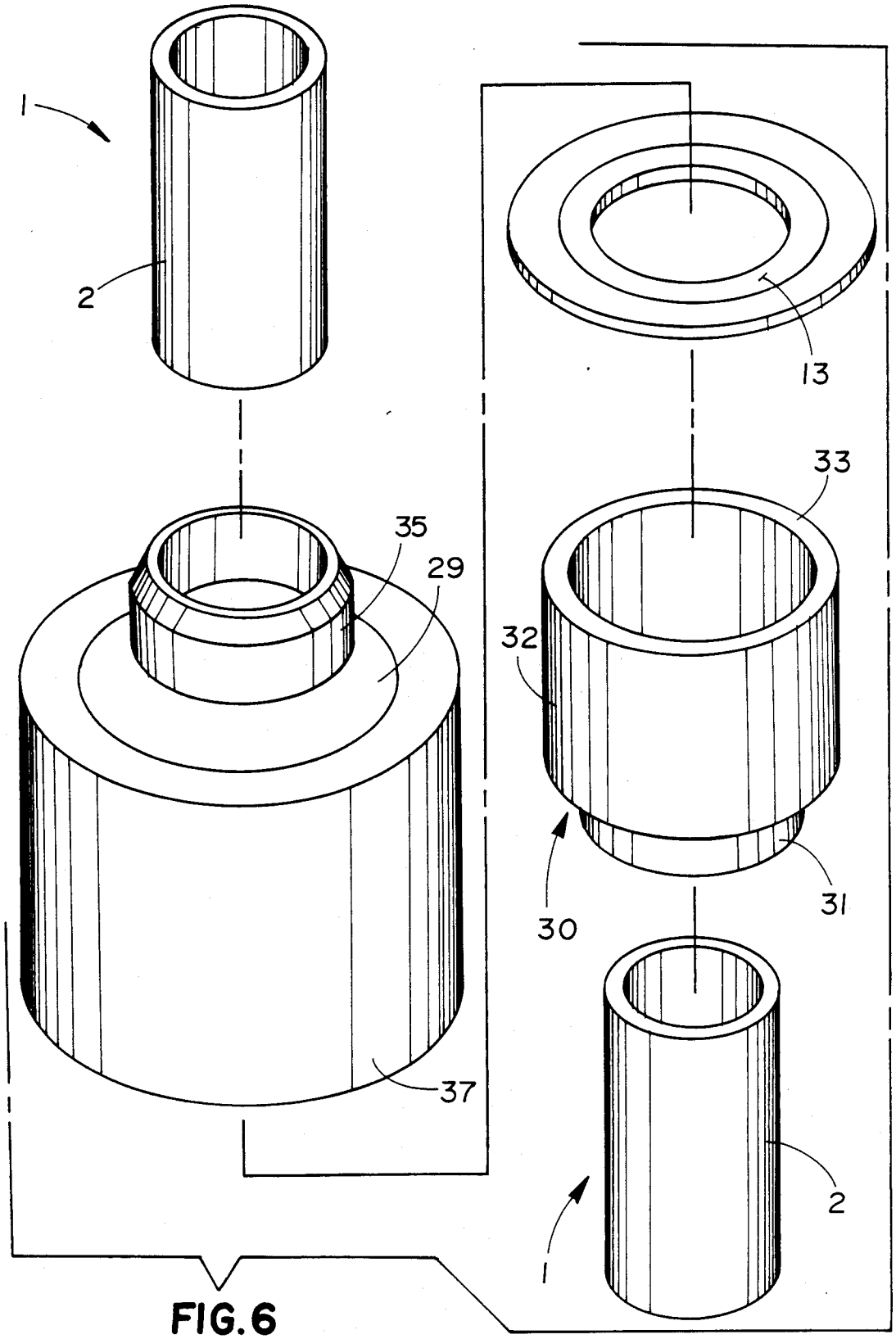
FIG. 6 is an exploded perspective view of the automatic air valve of FIG. 4.

Referring now to FIGS. 4–6, the tubular member 11 of the valve 10 is adapted to be connected at both ends thereof, so as to be interposed directly in the conduit flow line of the duct system 1. Accordingly, the tubular member 11 must be adapted, so that fluids, solids and/or foreign objects may freely pass therethrough. As such, the valve 10, the interior filter 14 and the interior support members 27 thereof, described relative to FIGS. 1–3 would not be suitable for use in such an arrangement because it would interfere with this free flow.

The tubular member 11 may be fabricated as a single integral unit. However, it is preferred to form the member 11 as a two-piece unit having an upper portion 29 and a lower portion 30 that "mate" with one another.

The lower portion 30 of the tubular member 11 includes a downwardly-extending annular flange 31 that is received on and secured to the conduit 2 therebelow by any suitable means. Above the flange 31, the lower portion 30 has a wall 32 that is offset outwardly from the flange 31 and which extends annularly about the flange 31 and upwardly therefrom, terminating in a first lip 33. It is noted that the lower end of the side of the wall 32 which faces the conduit 2 is inwardly curved, so as to form a rounded curved bend 34 therein. Preferably, this bend 34 is, at least, a substantially 90° bend.

The upper portion 29 of the tubular member 11 includes an upwardly-extending annular flange 35 that is received on and secured to the conduit 2 thereabove by any suitable means. Below the flange 35, the upper portion 29 further has an annular inner wall 36 that extends substantially vertically downwardly from the flange 35. The upper portion 29 further has an annular outer wall 37 that is spaced from the inner wall 36 and is offset outwardly from the flange 35, extending downwardly therefrom. Positioned thusly, the wall 32 of the lower portion 30 lies between (preferably substantially equidistantly between), and is spaced from, both the inner wall 36 and the outer wall 37 of the upper portion 29. In this fashion, the peripheral or annular passageway (flow passage) 12 is formed through the tubular member 11 in the form of a duct having an interior end, which is in direct communication with the interior of the conduit and the conduit flow line, and an exterior end that is in communication with the ambient environment.

As seen, the presence of the wall 32 of the lower portion 30 in between walls 36 and 37 forms a passageway 12 having a substantially 180° bend 38 formed therein. Also, the wall 36 and the curved portion 34 of the wall 32 cooperate to form a second substantially 90° bend 39 in that portion of the passageway 12 that lies between the freely-movable valve member 13 and the interior end of the passageway 12. In this fashion, the interior end of the passageway 12 is oriented at a substantially 90° angle to the flow of fluids, solids and/or foreign objects through the tubular member 11. If desired, the lower end of the wall 32 may be curved inwardly, forming a rounded bend therein that is between 90° and 180°, so that the second bend 39 is between 90° and 180°. In this fashion, the interior end of the passageway 12 may be oriented downwardly towards the conduit 2 therebelow.

Formed on the inner periphery of the upper portion 29 (on wall 37) is a second lip 40. Lip 40 is oriented towards and cooperates with lip 33 to form a valve seat in the passageway 12 substantially at the 180° bend 38 that is formed therein. It is to be noted that, if desired, wall 37 may be formed such that it extends downwardly, terminating coincidentially with the lip 40 formed thereon.

Once again, it will be seen that if a negative pressure occurs in the vertical conduit 2, for example as a result of draining, flushing, emptying or other operation, the freely-movable valve member 13 will be lifted from the valve seat formed by the lips 33 and 40 and into the unseated, open position. In this position, fresh air from the ambient environment can pass through the passageway 12 and into the conduit 2, equalizing the pressure in the conduit 2 with that of the ambient environment. Conversely, if the pressure in the vertical conduit 2 is equal to or greater than the pressure in the conduit 2 (an overpressure), the freely-movable valve member 13 will be lowered (seated) onto the valve seat formed by lips 33 and 40 and into the seated closed position. In this position, the freely-movable valve member 13 shuts off or seals the passageway 12, so that contaminated air in the conduit 2 is preventing from escaping therefrom into the ambient environment.

If desired, the diameter of the interior end of the passageway 12 may be adjusted as desired to either provide or discourage a venturi effect. In any event, due to the diameter of the passageway 12 at the interior end being smaller than the diameter of the conduit 2, an increase in the capacity of the valve is obtained which renders possible the use of the valve 10 in buildings having a greater use of stores. Also, the reduction in cross-section of the passageway 12, so that it has a diameter which is less than the diameter of the interior filter 14 aids in preventing the interior filter 14 from operatively interfering with the freely-movable valve member 13, as was discussed above.

Once again, any appropiate means may be employed for providing a means by which the annular valve member 13 may freely-vertically, operatively move, as described at length above.

The interior filter 14 is disposed in the tubular member 11 between the conduit 2 and the valve member 13. Thus, in the valve shown in FIGS. 4–6, this filter 14 may be situated at any position or level in the portion of the passageway 12 that is formed between the walls 32 and 36. Preferably, the interior filter 14 is disposed in the passageway 12, extending thereacross and being secured to the tubular member 11 or otherwise maintained in place, such as was described above. Alternatively, it may be disposed over the entrance to the interior end of the passageway 12, being secured to the tubular member 11 or otherwise maintained in place as was described. This filter 14 acts to retain foreign objects in the conduit 2, restraining said foreign objects from contacting and/or operatively interfering with the freely-movable valve member 13. Because this filter 14 is secured or otherwise maintained in place, as was described above, its movement is limited, so that it cannot move or be moved so as to operatively interfere with the freely-movable valve member 13.

It is contemplated herein that, once again, the interior filter 14 will be in the form of a grill fabricated from a plastic, metal or any other suitably rigid material. It is also contemplated herein that with reference to the valve illustrated in FIGS. 1–3, the interior filter 14 can, alternatively, have the nonplanar shapes described above with reference to FIGS. 8–11, with the attendant advantage of improved air flow provided thereby, as was described above.

A significant advantage for the valve 10 described above relative to FIGS. 4–6 is that the interior of the tubular member 11 remains entirely free of filters or other elements, so that it can be fitted to a device, such as a siphon, or so that it can be interposed in the conduit flow line of a duct system.

Figure 7:
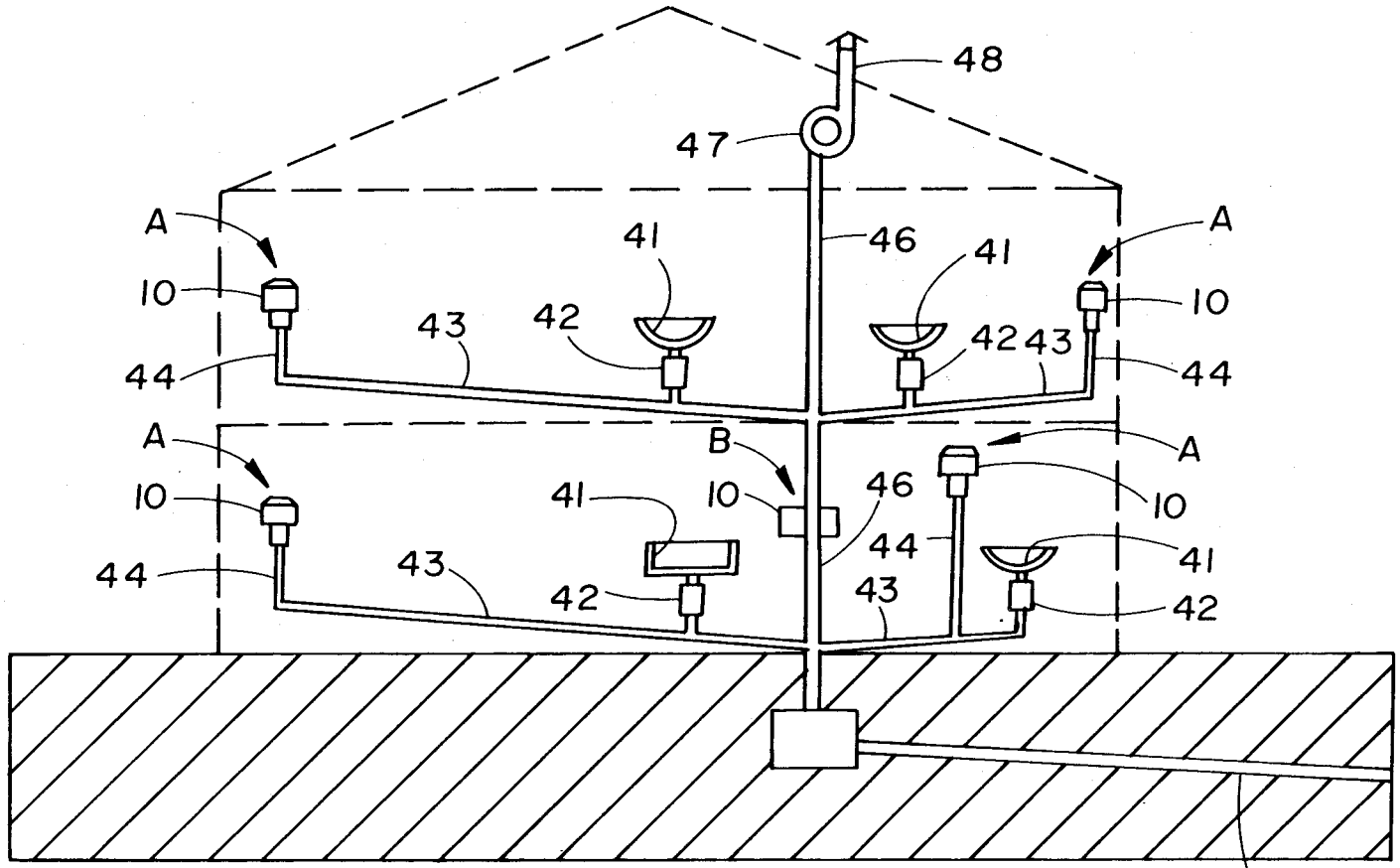
FIG. 7 illustrates the application of the automatic air valves of FIGS. 1–3 and 4–6.
Figure 10:
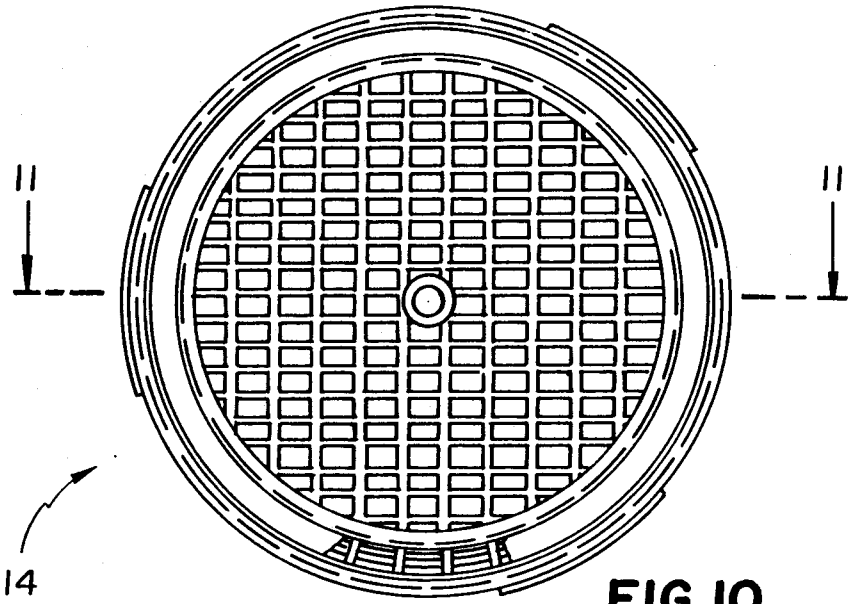
FIG. 10 is a top view of another preferred embodiment of the interior filter of the present invention.
Figure 11:
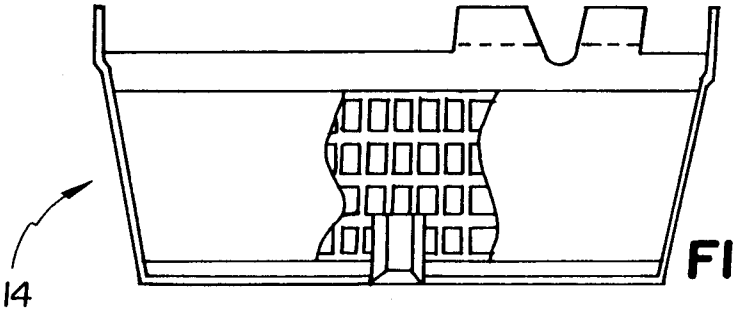
FIG. 11 is a cross-section view taken along lines 11—11 of FIG. 10.
Figure 8:
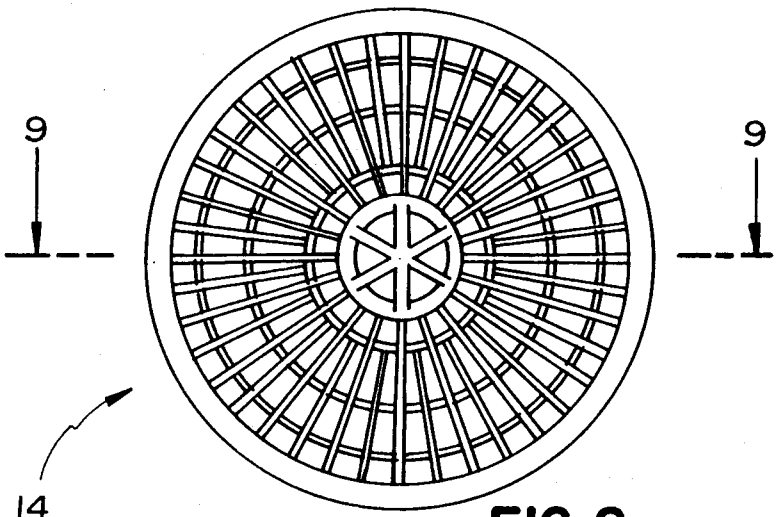
FIG. 8 is a top view of a preferred embodiment of the interior filter of the present invention.
Figure 9:
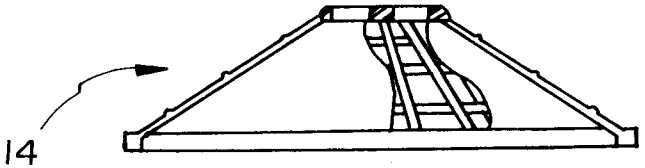
FIG. 9 is a cross-section view taken along lines 9—9 of FIG. 8.

With reference now to FIG. 7, the location of installation of the valves 10 in a duct system 1 of an ordinary house which is used for the discharge of waste water is illustrated. The devices 41 used to discharge water (such as a lavatory, a basin, sinks, etc.) are provided with respective traps or siphons 42. Each trap or siphon 42 is, in turn, connected a substantially horizontal inclined conduit 43. Also, if desired, substantially vertical valve conduits 44 may be connected to respective inclined conduits 43. These valve conduits 44 are positioned substantially at the terminus of respective conduit flow lines of the duct system.

Each of the inclined conduits 43 is, in turn, connected to a main waste conduit 45 via a substantially vertical main venting conduit 46 having a fan 47. Fan 47 includes an outlet 48 for delivery to the atmosphere. When this fan 46 is in operation, it produces a negative pressure in the conduits 43, 44 and 46 lifting the different freely-movable valve members 13 of the different valves 10. In this way, stale air can thereby be discharged from the duct system via conduit 46 at outlet 48.

Automatic valves 10 of the type discussed with reference to FIGS. 1–3 are disposed at the terminus of the conduit flow line (on the valve conduits 44) as at A. Automatic valves 10 of the type discussed with reference to FIGS. 4–6 are interposed in the conduit flow line (in the main venting conduit 46) as at B.

Obviously, many modifications may be made without departing from the basic spirit of the present invention. For example, if desired, the precise shapes of the passageway 12 and the precise positioning of the freely-movable valve members 13 may be varied somewhat and other elements, such as insulation as is described in U.S. Pat. No. 4,232,706, may be provided surrounding the valves 10. Accordingly, it will be appreciated by those skilled in the art that, within the scope of the appended claims, the invention may be practiced other than has been specifically described herein.

What is claimed is:

1. An automatic air valve for a duct system having a conduit through which passes fluids and/or solids, the conduit further having a pressure therein, said air valve comprised, in combination, of:

a tubular member connected to the conduit, such that fluids and/or solids pass therebelow in the conduit;

a passageway formed in the tubular member between the conduit and the ambient environment outside the conduit, whereby gaseous communication is provided therebetween;

a freely-movable valve member disposed in communication with the passageway for automatically controlling the flow of air therethrough, said valve member being operatively freely-movable between a seated closed position, wherein the flow of air through the passageway is prevented when the pressure in the conduit is equal to or exceeds the pressure of the ambient environment, and an unseated open position, wherein the flow of air through the passageway is permitted when the pressure in the conduit is less than the pressure of the ambient environment for admitting atmospheric air into the conduit in response to a negative pressure in the conduit;

an interior filter disposed between the conduit and the freely-movable valve member, whereby foreign objects in the conduit are restrained from operatively interfering with the freely-movable valve member; the interior filter having a diameter;

the interior filter having a diameter;

a portion of the passageway located between the interior filter and the freely-movable valve member having a substantially frustum-shaped constriction formed therein so as to be reduced in cross-section to a diameter being less than the diameter of the interior filter, whereby a venturi effect is provided, and further whereby the interior filter is prevented from moving or being moved towards the freely-movable valve member and into a position wherein the interior filter may operatively interfere with the freely-movable valve member; and wherein the interior filter is substantially frustum-shaped, so as to substantially correspond to the shape of the frustum-shaped constriction formed in the passageway, whereby a total air passage area that corresponds to the air passage area that is present without the interior filter is provided for preventing restriction of the flow of air therethrough and maintaining the venturi effect.

2. The automatic air valve of claim 1, further comprised of:

an annular support ring concentrically positioned about the tubular member, the annular support ring being supported and carried by the tubular member, such that a valve seat is formed between the said annular support ring and the tubular member, said valve seat being adapted to receive the freely-movable valve member thereon for automatically controlling the flow of air therethrough.

3. The automatic air valve of claim 1, wherein the interior filter is substantially frusto-conical in shape, and further wherein the portion of the passageway located between the interior filter and the freely-movable valve has a substantially frusto-conical shaped constriction formed therein.

* * * * *